US011898229B2

(12) United States Patent
Wang et al.

(10) Patent No.: US 11,898,229 B2
(45) Date of Patent: Feb. 13, 2024

(54) HIGH-STRENGTH AND HIGH-PLASTICITY CASTING HIGH-ENTROPY ALLOY (HEA) AND PREPARATION METHOD THEREOF

(71) Applicant: Shanghai Institute of Technology, Shanghai (CN)

(72) Inventors: Zemin Wang, Shanghai (CN); Jiajun Li, Shanghai (CN); Yu Dong, Shanghai (CN); Min Liu, Shanghai (CN); Linghuan Pang, Shanghai (CN); Bin Fu, Shanghai (CN); Zhanyong Wang, Shanghai (CN)

(73) Assignee: SHANGHAI INSTITUTE OF TECHNOLOGY, Shanghai (CN)

( * ) Notice: Subject to any disclaimer, the term of this patent is extended or adjusted under 35 U.S.C. 154(b) by 0 days.

(21) Appl. No.: 17/862,197

(22) Filed: Jul. 11, 2022

(65) Prior Publication Data

US 2023/0016108 A1 Jan. 19, 2023

(30) Foreign Application Priority Data

Jul. 19, 2021 (CN) ..... 202110814417.1

(51) Int. Cl.
*C22C 30/02* (2006.01)
*C22C 1/02* (2006.01)

(52) U.S. Cl.
CPC ..... *C22C 30/02* (2013.01); *C22C 1/02* (2013.01)

(58) Field of Classification Search
USPC ..... 420/582
See application file for complete search history.

(56) References Cited

FOREIGN PATENT DOCUMENTS

SU 517658 A * 7/1976

OTHER PUBLICATIONS

English language machine translation of SU-517658-A. Generated Jun. 9, 2023. (Year: 2023).*

* cited by examiner

*Primary Examiner* — Brian D Walck
(74) *Attorney, Agent, or Firm* — Hamilton, Brook, Smith & Reynolds, P.C.

(57) ABSTRACT

The present disclosure provides a high-strength and high-plasticity casting high-entropy alloy (HEA), having a general formula of $Al_aCo_bCr_cTi_dFe_eNi_fCu_g$, where $6.0<a\leq8.0$, $18.0<b\leq23.0$, $7.5\leq c<12.5$, $2.0<d\leq8.5$, $15.5<e\leq20.0$, $28.0<f\leq37.0$, $0.2<g\leq10.0$, and $a+b+c+d+e+f+g=100$. The casting HEA can be prepared in one step and has excellent mechanical properties. The various metal raw materials are environmental-friendly and suitable for large-scale industrial production.

20 Claims, 18 Drawing Sheets

HIGH-STRENGTH AND HIGH-PLASTICITY CASTING HIGH-ENTROPY ALLOY (HEA) AND PREPARATION METHOD THEREOF

CROSS REFERENCE TO RELATED APPLICATION

This patent application claims the benefit and priority of Chinese Patent Application No. 202110814417.1, filed on Jul. 19, 2021, the disclosure of which is incorporated by reference herein in its entirety as part of the present application.

TECHNICAL FIELD

The present disclosure relates to a high-strength and high-plasticity casting high-entropy alloy (HEA) and a preparation method thereof, and belongs to the technical field of metal materials.

BACKGROUND ART

HEA is a multi-principle element alloy with simple phases in which four or more different metal elements are mixed in an equal or approximately-equal atomic ratio. At present, the research on HEAs is still in an early stage, and the HEAs prepared by current technical means are generally difficult to have a high strength and desirable plasticity. To solve this problem, materials scientists have designed eutectic HEAs including two different phases, where one has an extremely strong strength and the other has a better plasticity, thus combining the high strength and the desirable plasticity. However, the comprehensive mechanical properties of currently-reported HEAs do not significantly exceed those of traditional alloys, and HEAs with excellent mechanical properties generally require complex deformation and heat treatment processes, making actual production difficult. Therefore, the technological bottleneck now facing is to improve the comprehensive mechanical properties of HEAs, while simplifying the production process to realize industrial application.

Currently, most of the researches are developing novel HEA systems, or making an internal structure of the HEA refined, dense or directional by complex microstructure control combined with deformation and heat treatment methods in the existing HEA systems, thereby improving the comprehensive mechanical properties of the HEA. However, the complex microstructure control combined with deformation and heat treatment methods may increase a difficulty of industrial production to hinder the process of industrial application. Accordingly, it has become an urgent technical problem to be solved to design a composition, such that HEAs with excellent mechanical properties can be prepared by a simple and one-step casting method.

SUMMARY

To solve the above shortcomings, the present disclosure provides a high-strength and high-plasticity casting HEA capable of achieving excellent mechanical properties by only one-step casting and a preparation method thereof. The HEA has a high tensile strength and desirable plasticity, and has a simple preparation method. The HEA is safe, reliable and practical, with broad prospects for use in the engineering field.

To solve the above-mentioned technical problems, the present disclosure adopts the following technical solutions:

The present disclosure provides a high-strength and high-plasticity casting HEA, having a general formula of $Al_aCo_bCr_cTi_dFe_eNi_fCu_g$, where $6.0<a\leq8.0$, $18.0<b\leq23.0$, $7.5\leq c<12.5$, $2.0<d\leq8.5$, $15.5<e\leq20.0$, $28.0<f\leq37.0$, $0.2<g\leq10.0$, and $a+b+c+d+e+f+g=100$.

Preferably, in the general formula of the HEA, $6.9<a\leq7.5$, $20.2<b\leq21.9$, $10.1\leq c<11.0$, $4.6<d\leq5.0$, $20.2<e\leq21.9$, $30.3<f\leq32.9$, and $0.5<g\leq7.5$.

Preferably, the HEA may have a tensile strength of 900 MPa to 1,200 MPa and an elongation of 15% to 24%.

The present disclosure further provides a preparation method of the high-strength and high-plasticity casting HEA, including the following steps:

step 1): completely cleaning bulk particles of Al, Co, Cr, Cu, Fe, Ni, and Ti elementary substances, and weighing according to a proportion;

step 2): vacuumizing a vacuum smelting furnace to not more than $6.0\times10^4$ Pa, and introducing a protective gas; adding Ti into the vacuum smelting furnace for deoxidation, adding the rest of the elementary substances for melting, and stirring for smelting; and step 3): after the smelting is completed, pouring an alloy obtained in step 2) into a water cooling plate-shaped copper mold for casting, cooling to room temperature, and collecting a finished product.

Preferably, in step 1), the elementary substances each may have a purity of not less than 99.95%.

Preferably, in step 2), the vacuum smelting furnace may be a vacuum arc smelting furnace or a vacuum induction smelting furnace.

Preferably, in step 2), the protective gas may be argon or other gas that does not react with metal raw materials, having a purity of 99.999%.

Preferably, in step 2), the smelting may be conducted by overturning type smelting 5 times with 5 min in each time.

Preferably, in step 3), the alloy may have a thickness of not less than 8 mm.

Preferably, in step 3), the alloy may have a uniformly-distributed dendritic structure.

In the present disclosure, a high-strength and high-plasticity casting HEA is prepared through composition design. Studies have shown that the HEA with a high tensile strength of 900 MPa to 1,200 MPa and a desirable ductility of 15% to 24% has a great potential in practical applications. Since large blocks of the casting HEA can be prepared by one-step casting, with an extremely mature casting process during the industrial production, the preparation method has a great potential for industrial production.

Compared with the prior art, the present disclosure has the following outstanding substantive features and significant advantages:

1. In the present disclosure, a casting HEA includes Al, Co, Cr, Cu, Fe, Ni, and Ti elements; the casting HEA with high tensile strength and desirable plasticity is prepared by composition design and casting, which has broad prospects for use in the engineering field.

2. The casting HEA has a stable microstructure under the high-temperature environment.

3. In the present disclosure, the preparation method has a simple process, easy operation and easily-available raw materials, is safe, reliable and practical, and is suitable for large-scale industrial production.

BRIEF DESCRIPTION OF THE DRAWINGS

FIG. 1OF shows an X-ray energy spectrum-based Fe element area profile of the $Al_{7.3}Co_{21.4}Cr_{10.6}Ti_{4.9}Fe_{21.4}Ni_{31.9}Cu_{2.5}$ casting HEA prepared in Example 2;

DETAILED DESCRIPTION OF THE EMBODIMENTS

Figure 1:
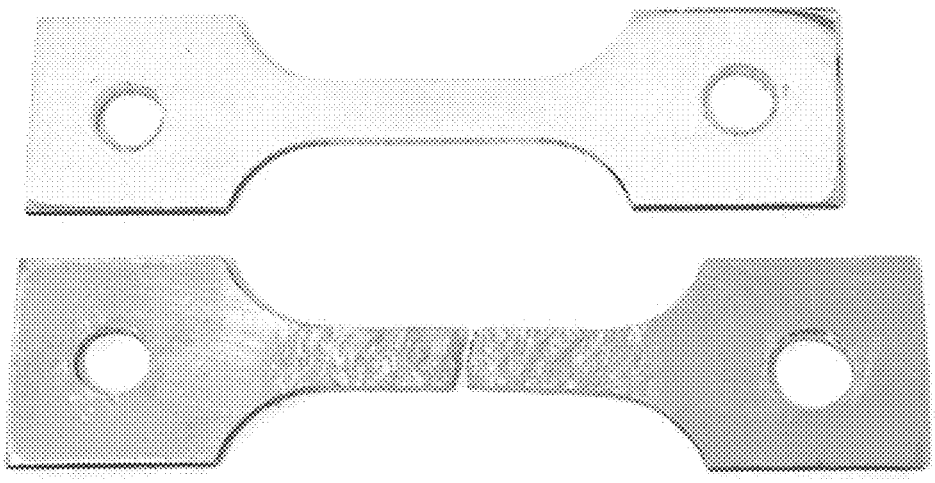
FIG. 1 shows comparison photos of an $Al_{7.6}Co_{21.7}Cr_{10.9}Ti_{5.2}Fe_{21.7}Ni_{32.3}Cu_{0.6}$ casting HEA sample prepared in Example 1 before and after stretching.

In order to make the present disclosure more understandable, preferred examples are provided to describe in detail as follows.

In each example, tests and equipment involved are as follows:

a high vacuum non-consumable arc smelting furnace: an NF-800 high vacuum non-consumable arc smelting furnace produced by Deyang Aona New Material Co., Ltd. in Sichuan, China;

microstructure: metallographic observation is conducted using an Axio Observer D1M inverted metallographic microscope produced by Carl Zeiss; a metallographic sample has a size of 5 mm×5 mm×5 mm; the sample is inlaid with phenolic resin, and then polished with 400 #, 600 #, 1000 #, 1500 #, and 3000 #silicon carbide sandpapers in sequence, and then polished using a diamond polishing paste with a particle size of 1.5 μm; a scanning electron microscope is a Gemini 300 field-emission scanning electron microscope produced by Carl Zeiss, and an X-ray energy dispersive analysis is conducted by an X-Max large-area electric cooling energy spectral detection system produced by Oxford Instruments; and Quasi-static tensile mechanical properties test: according to a standard GB/T228.1-2010, axial quasi-static tensile test at room temperature was conducted using a Zwick Z020 microcomputer-controlled electronic universal testing machine, where a strain rate is selected as $10^{-3}$ $s^{-1}$, and a test sample is a non-standard I-shaped piece, with a thickness of 1.20 mm, a length of 61 mm, a gauge length of 15.00 mm, and a gauge length of 5.00 mm.

EXAMPLE 1

A high-strength and high-plasticity casting HEA had a general formula of $Al_{7.6}Co_{21.7}Cr_{10.9}Ti_{5.2}Fe_{21.7}Ni_{32.3}Cu_{0.6}$.

A preparation method included the following steps:

step 1, pre-preparation of a sample:

high-purity particles of Al, Co, Cr, Cu, Fe, Ni, and Ti elementary substances each with a purity of not less than 99.95% were completely cleaned with ultrasonic acetone, and air-dried after cleaning; and clean raw materials with a total mass of 500.00 g±0.02 g were accurately weighed using an analytical balance and according to an atomic ratio of Al, Co, Cr, Ti, Fe, Ni and Cu at 7.6:21.7:10.9:5.2:21.7:32.3:0.6;

step 2, alloy melting:

cleaned high-purity metal raw materials Al, Co, Cr, Cu, Fe, Ni, and Ti were put into an inner working position of an electric arc smelting furnace, and a vacuum hood of the electric arc furnace was closed; a valve of an oil-sealed mechanical pump was opened, and the furnace was vacuumized using the oil-sealed mechanical pump to not more than $3.0\times10^{0}$ Pa; the valve of the oil-sealed mechanical pump was closed; a valve of a turbo molecular pump was opened, and the furnace was vacuumized using the turbo molecular pump to less than $6.0\times10^{-4}$ Pa; the turbo molecular pump valve was closed, a protective gas filling valve was opened, and the vacuum hood was filled with high-purity argon in a purity of 99.999% to complete the vacuumizing and filling; and alloy smelting was conducted: the alloys were put into stations of the smelting furnace separately, the metal Ti was smelted for deoxidation, and the rest of the metals were added for melting in the high-vacuum smelting furnace; after all the metals were melted, electromagnetic stirring was conducted to make a melt fully stirred; during the smelting, an alloy ingot was subjected to overturning type smelting 5 times with about 5 min in each time; and step 3, after the smelting was completed, an alloy obtained in step 2 was poured into a square water cooling plate-shaped copper mold for casting, cooled to room temperature to obtain the HEA.

A casting HEA with dimensions of 100 mm×100 mm×6 mm was obtained from a casting plate of the casting HEA prepared in step 3 by wire EDM and milling.

Figure 2:
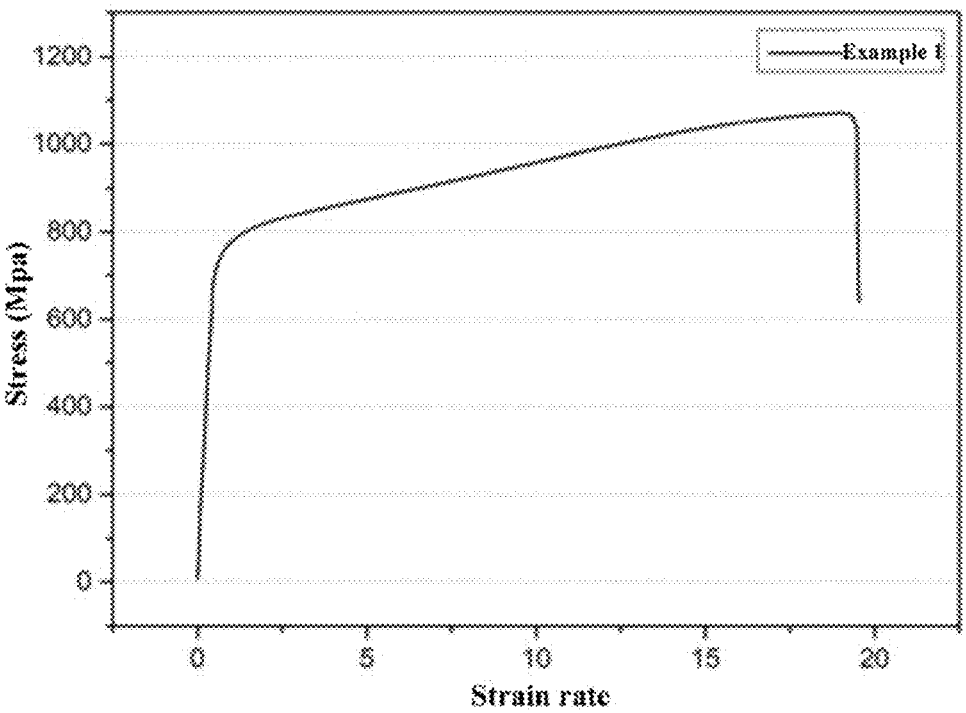
FIG. 2 shows an engineering stress-strain curve of static stretching of the $Al_{7.6}Co_{21.7}Cr_{10.9}Ti_{5.2}Fe_{21.7}Ni_{32.3}Cu_{0.6}$ casting HEA prepared in Example 1.
Figure 3:
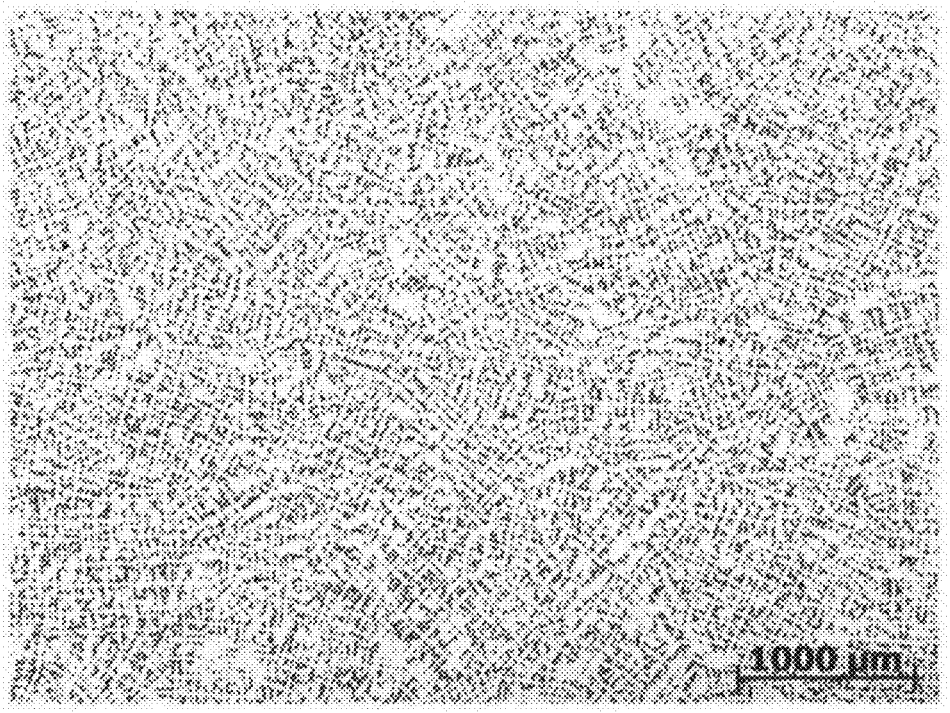
FIG. 3 shows a metallographic diagram of the $Al_{7.6}Co_{21.7}Cr_{10.9}Ti_{5.2}Fe_{21.7}Ni_{32.3}Cu_{0.6}$ casting HEA prepared in Example 1.
Figure 4:
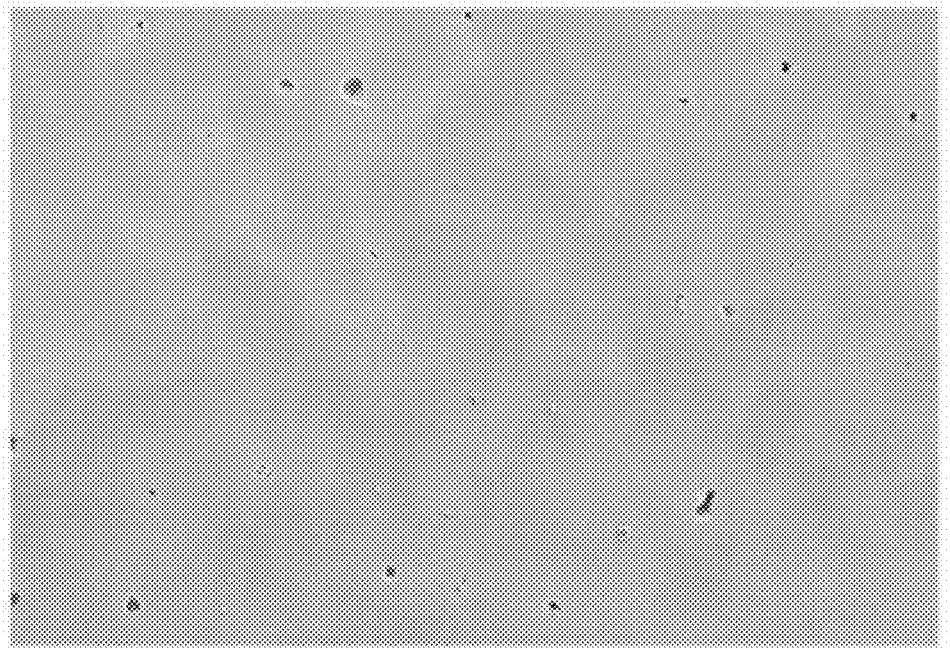
FIG. 4 shows a secondary electron image of the $Al_{7.6}Co_{21.7}Cr_{10.9}Ti_{5.2}Fe_{21.7}Ni_{32.3}Cu_{0.6}$ casting HEA prepared in Example 1.
Figure 5A:
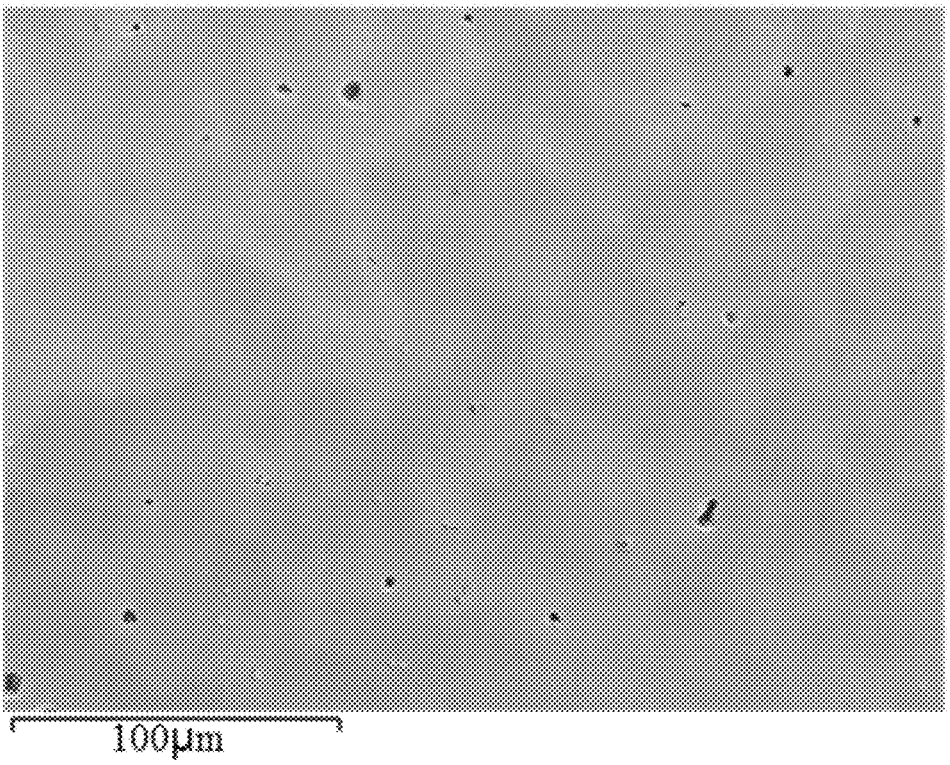
FIG. 5A shows a scanning electron microscope image of the $Al_{7.6}Co_{21.7}Cr_{10.9}Ti_{5.2}Fe_{21.7}Ni_{32.3}Cu_{0.6}$ casting HEA prepared in Example 1.
Figure 5B:
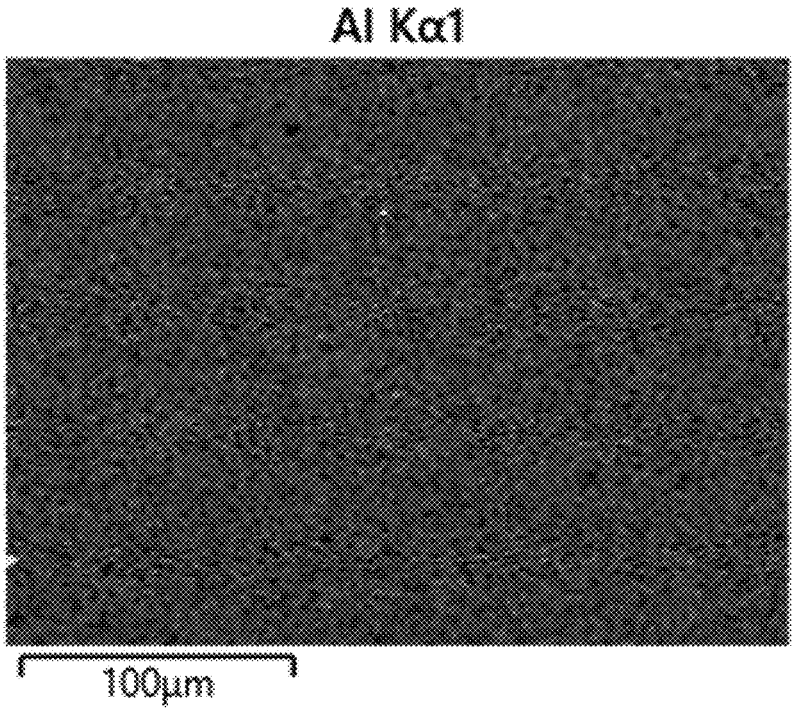
FIG. 5B shows an X-ray energy spectrum-based Al element area profile of the $Al_{7.6}Co_{21.7}Cr_{10.9}Ti_{5.2}Fe_{21.7}Ni_{32.3}Cu_{0.6}$ casting HEA prepared in Example 1.
Figure 5C:
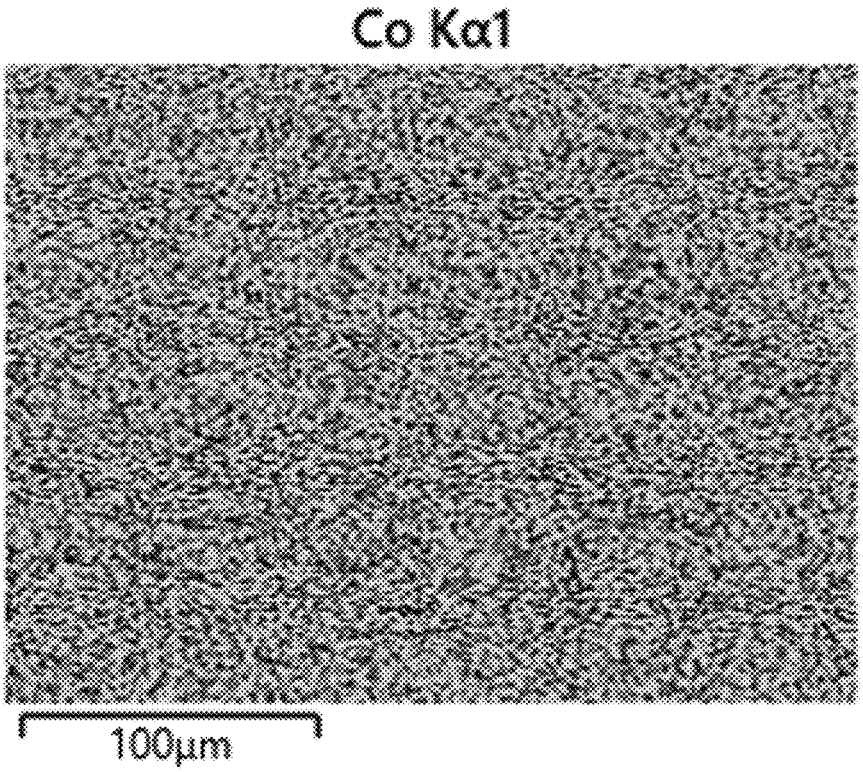
FIG. 5C shows an X-ray energy spectrum-based Co element area profile of the $Al_{7.6}Co_{21.7}Cr_{10.9}Ti_{5.2}Fe_{21.7}Ni_{32.3}Cu_{0.6}$ casting HEA prepared in Example 1.
Figure 5D:
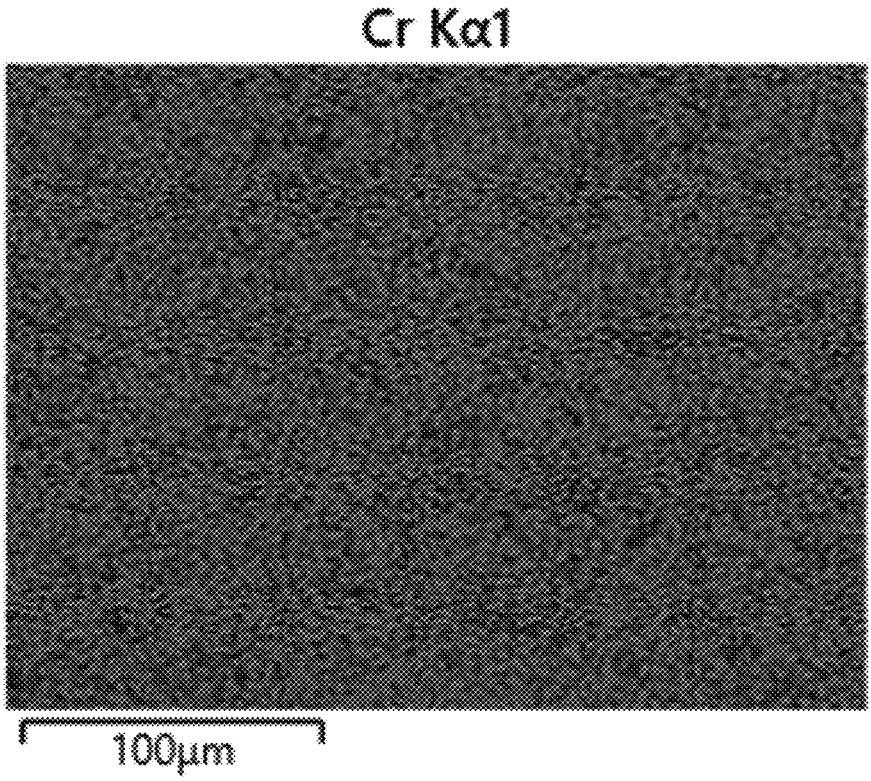
FIG. 5D shows an X-ray energy spectrum-based Cr element area profile of the $Al_{7.6}Co_{21.7}Cr_{10.9}Ti_{5.2}Fe_{21.7}Ni_{32.3}Cu_{0.6}$ casting HEA prepared in Example 1.
Figure 5E:
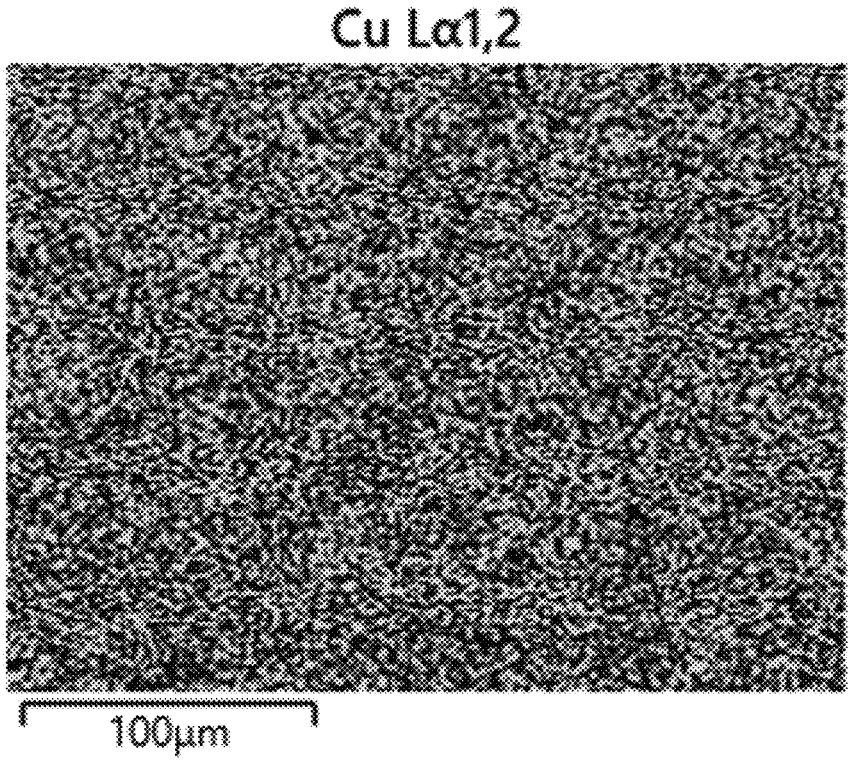
FIG. 5E shows an X-ray energy spectrum-based Cu element area profile of the $Al_{7.6}Co_{21.7}Cr_{10.9}Ti_{5.2}Fe_{21.7}Ni_{32.3}Cu_{0.6}$ casting HEA prepared in Example 1.
Figure 5F:
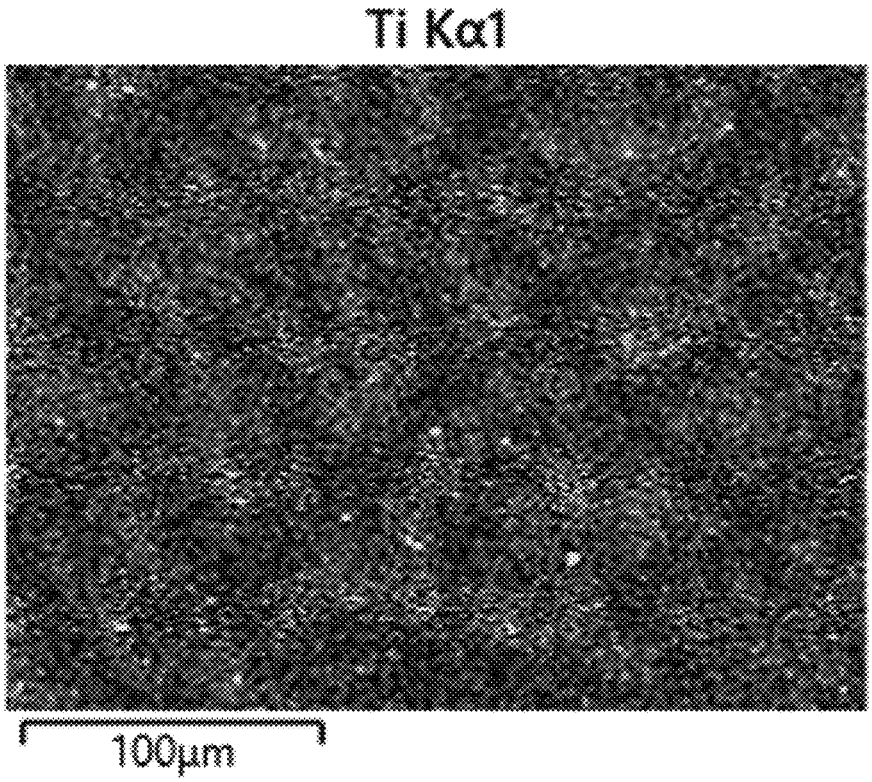
FIG. 5F shows an X-ray energy spectrum-based Ti element area profile of the $Al_{7.6}Co_{21.7}Cr_{10.9}Ti_{5.2}Fe_{21.7}Ni_{32.3}Cu_{0.6}$ casting HEA prepared in Example 1.
Figure 5G:
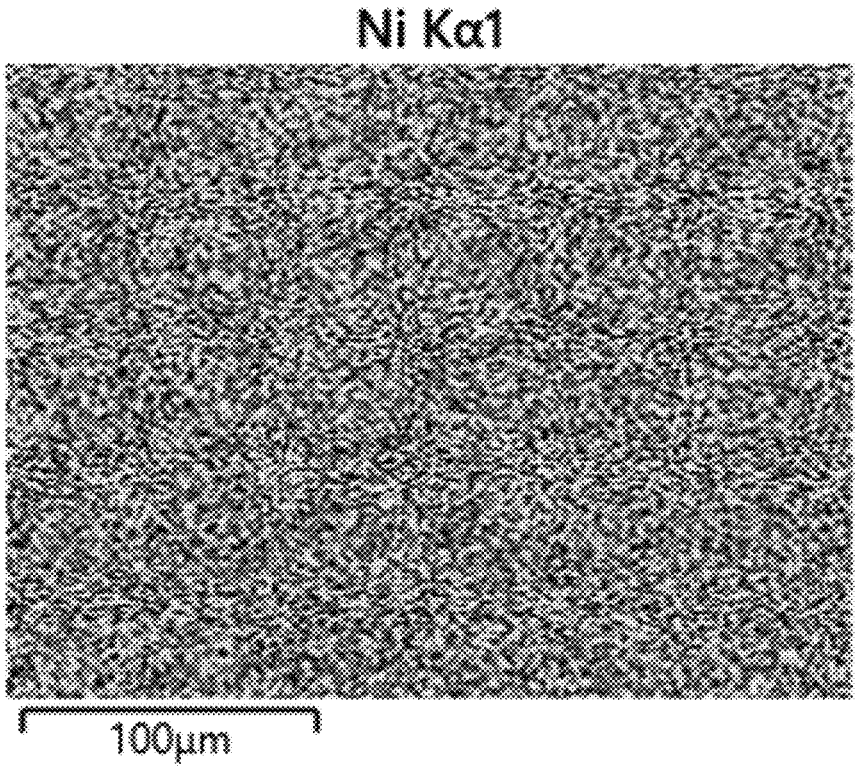
FIG. 5G shows an X-ray energy spectrum-based Ni element area profile of the $Al_{7.6}Co_{21.7}Cr_{10.9}Ti_{5.2}Fe_{21.7}Ni_{32.3}Cu_{0.6}$ casting HEA prepared in Example 1.
Figure 5H:
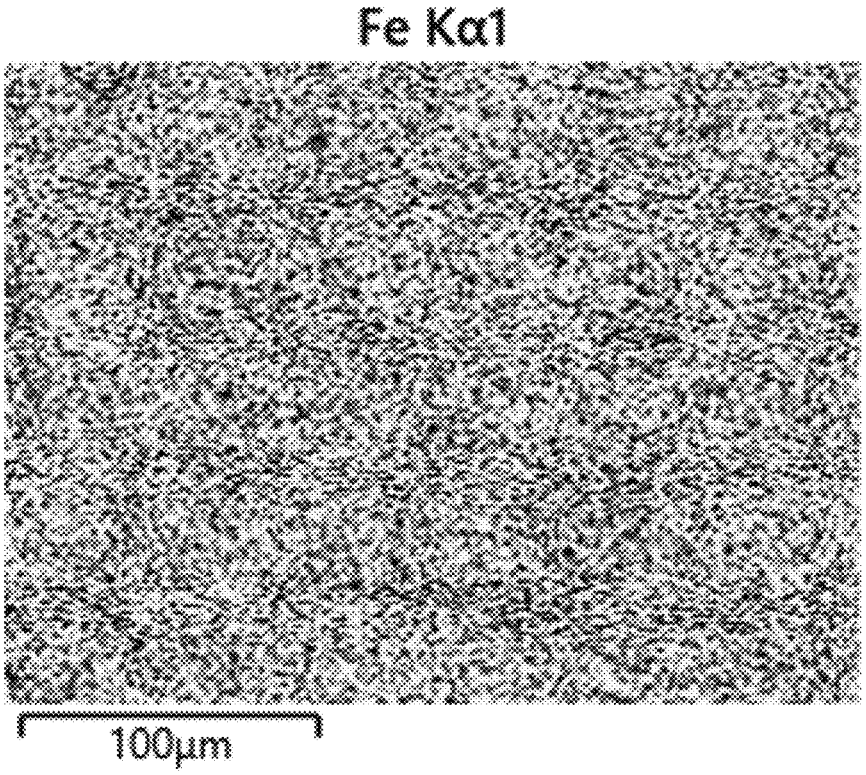
FIG. 5H shows an X-ray energy spectrum-based Fe element area profile of the $Al_{7.6}Co_{21.7}Cr_{10.9}Ti_{5.2}Fe_{21.7}Ni_{32.3}Cu_{0.6}$ casting HEA prepared in Example 1.
Figure 6:
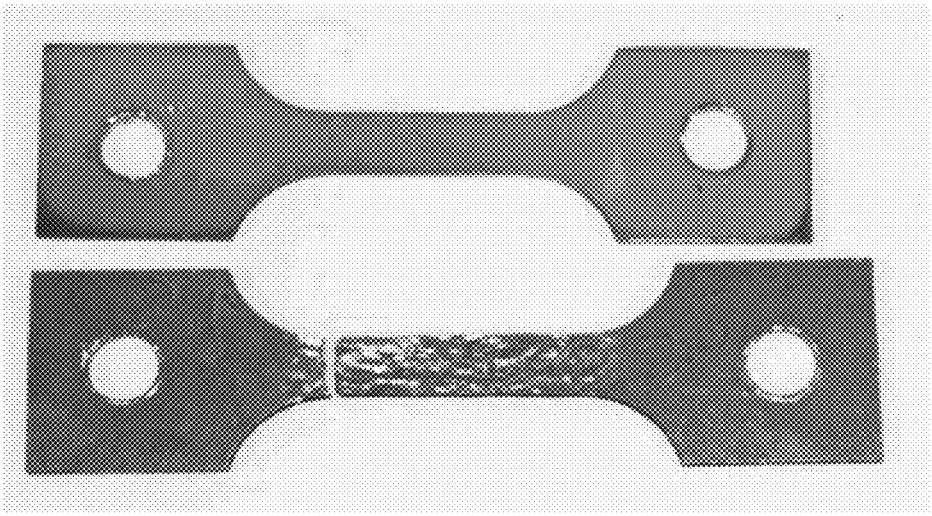
FIG. 6 shows comparison photos of an $Al_{7.3}Co_{21.4}Cr_{10.6}Ti_{4.9}Fe_{21.4}Ni_{31.9}Cu_{2.5}$ casting HEA sample prepared in Example 2 before and after stretching.

Experimental test and analysis:

The $Al_{7.6}Co_{21.7}Cr_{10.9}Ti_{5.2}Fe_{21.7}Ni_{32.3}Cu_{0.6}$ casting HEA prepared in this example was used as a test sample for experimental inspection. According to tensile test results in FIG. 2, the $Al_{7.6}Co_{21.7}Cr_{10.9}Ti_{5.2}Fe_{21.7}Ni_{32.3}Cu_{0.6}$ casting HEA has a tensile strength of 1071 MPa and an elongation at break of 19.5%. It can be seen from a metallographic structure in FIG. 3 that the $Al_{7.6}Co_{21.7}Cr_{0.9}Ti_{5.2}Fe_{21.7}Ni_{32.3}Cu_{0.6}$ casting HEA is mainly composed of FCC and $L_12$ phases, with a uniformly-distributed casting dendritic structure. From a scanning electron microscope image in FIG. 4 and an element area profile in FIGS. 5A-5H, it can be seen that elements Co, Cr, Fe, and Ni are distributed in a dendrite region, while elements Cu, Al, and Ti are distributed in an interdendritic region.

EXAMPLE 2

A high-strength and high-plasticity casting HEA had a general formula of $Al_{7.3}Co_{21.4}Cr_{10.6}Ti_{4.9}Fe_{21.4}Ni_{31.9}Cu_{2.5}$.

A preparation method included the following steps:

step 1, pre-preparation of a sample:

high-purity particles of Al, Co, Cr, Cu, Fe, Ni, and Ti elementary substances each with a purity of not less than 99.95% were completely cleaned with ultrasonic acetone, and air-dried after cleaning; and clean raw materials with a total mass of 500.00 g±0.02 g were accurately weighed using an analytical balance and according to an atomic ratio of Al, Co, Cr, Ti, Fe, Ni and Cu at 7.3:21.4:10.6:4.9:21.4:31.9:2.5;

step 2, alloy melting:

cleaned high-purity metal raw materials Al, Co, Cr, Cu, Fe, Ni, and Ti were put into an inner working position of an electric arc smelting furnace, and a vacuum hood of the electric arc furnace was closed; a valve of an oil-sealed mechanical pump was opened, and the furnace was vacuumized using the oil-sealed mechanical pump to not more than $3.0\times10^{0}$ Pa; the valve of the oil-sealed mechanical pump was closed; a valve of a turbo molecular pump was opened, and the furnace was vacuumized using the turbo molecular pump to less than $6.0\times10^{-4}$ Pa; the turbo molecular pump valve was closed, a protective gas filling valve was opened, and the vacuum hood was filled with high-purity argon in a purity of 99.999% to complete the vacuumizing and filling; and alloy smelting was conducted: the alloys were put into stations of the smelting furnace separately, the metal Ti was smelted for deoxidation, and the rest of the metals were added for melting in the high-vacuum smelting furnace; after all the metals were melted, electromagnetic stirring was conducted to make a melt fully stirred; during the smelting, an alloy ingot was subjected to overturning type smelting 5 times with about 5 min in each time; and step 3, after the smelting was completed, an alloy obtained in step 2 was poured into a square water cooling plate-shaped copper mold for casting, cooled to room temperature to obtain the HEA.

A casting HEA with dimensions of 100 mm×100 mm×6 mm was obtained from a casting plate of the casting HEA prepared in step 3 by wire EDM and milling.

Figure 7:
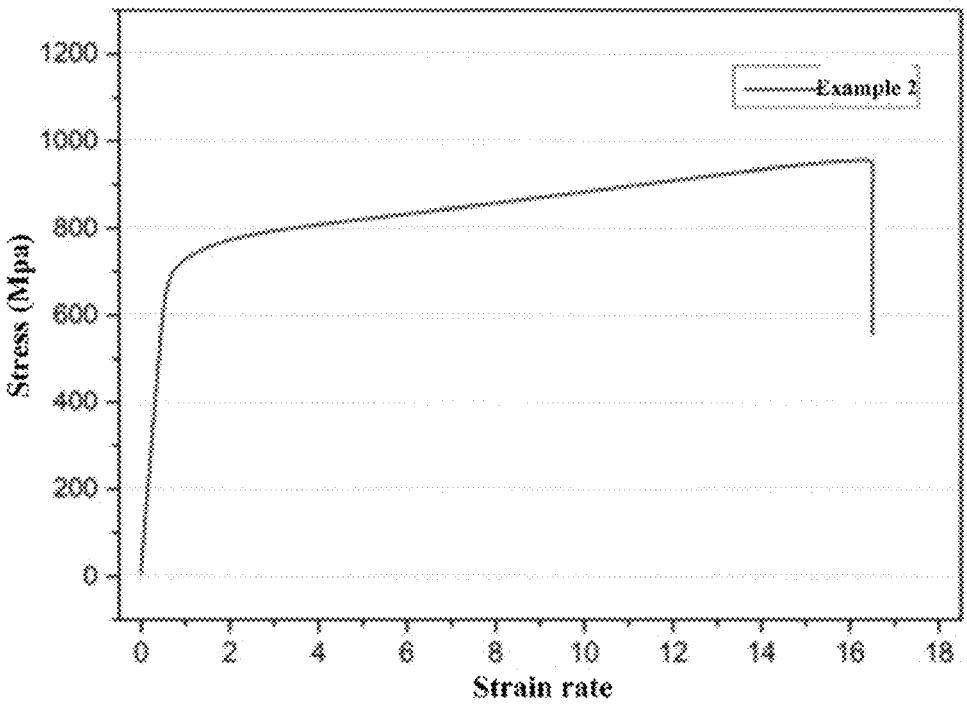
FIG. 7 shows an engineering stress-strain curve of static stretching of the $Al_{7.3}Co_{21.4}Cr_{10.6}Ti_{4.9}Fe_{21.4}Ni_{31.9}Cu_{2.5}$ casting HEA prepared in Example 2.
Figure 8:
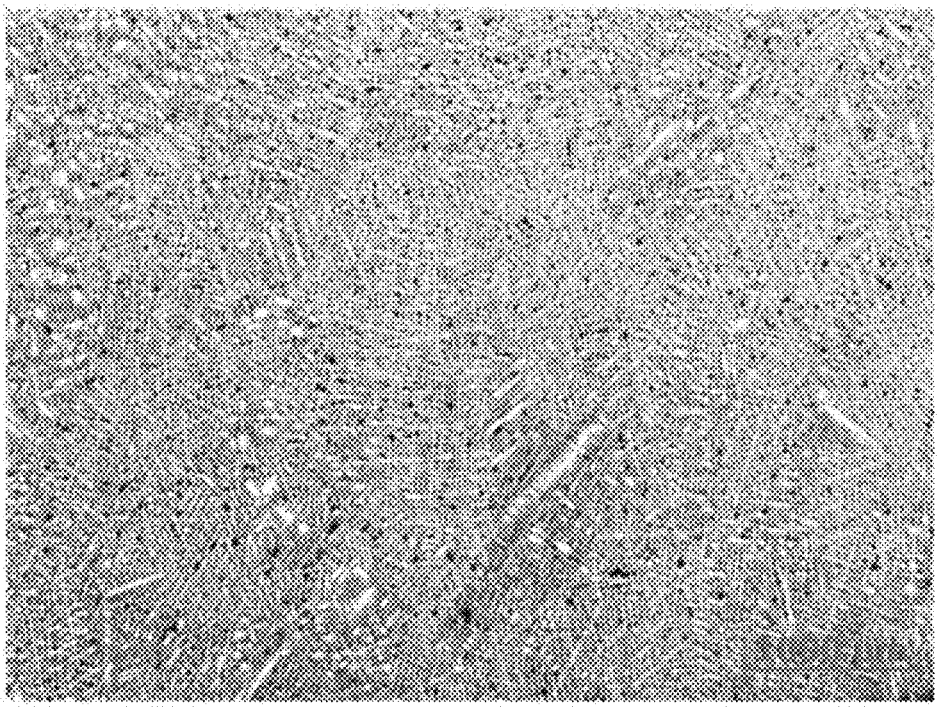
FIG. 8 shows a metallographic diagram of the $Al_{7.3}Co_{21.4}Cr_{10.6}Ti_{4.9}Fe_{21.4}Ni_{31.9}Cu_{2.5}$ casting HEA prepared in Example 2.
Figure 9:
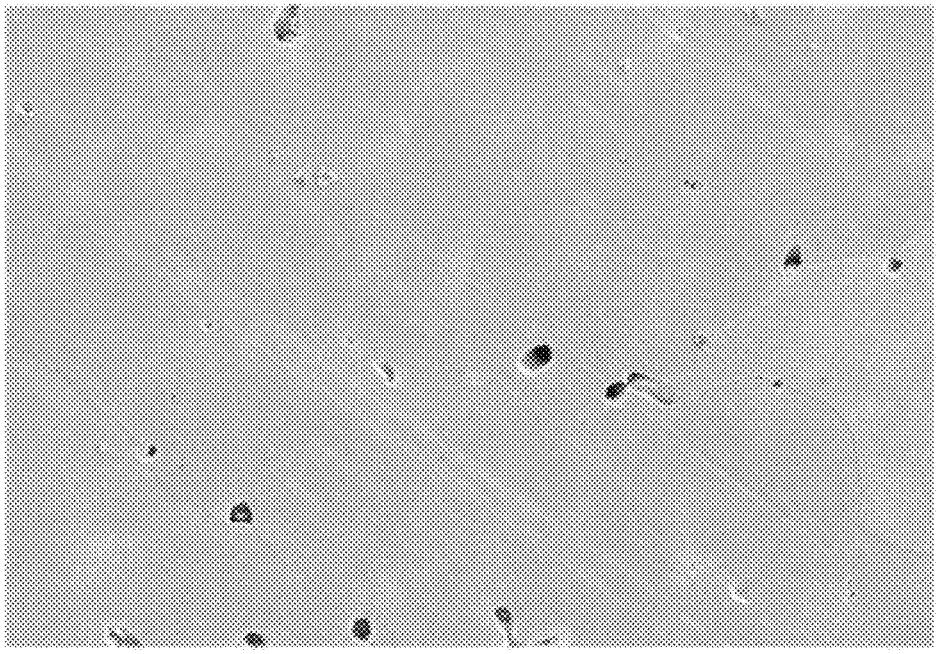
FIG. 9 shows a secondary electron image of the $Al_{7.3}Co_{21.4}Cr_{10.6}Ti_{4.9}Fe_{21.4}Ni_{31.9}Cu_{2.5}$ casting HEA prepared in Example 2.
Figure 10A:
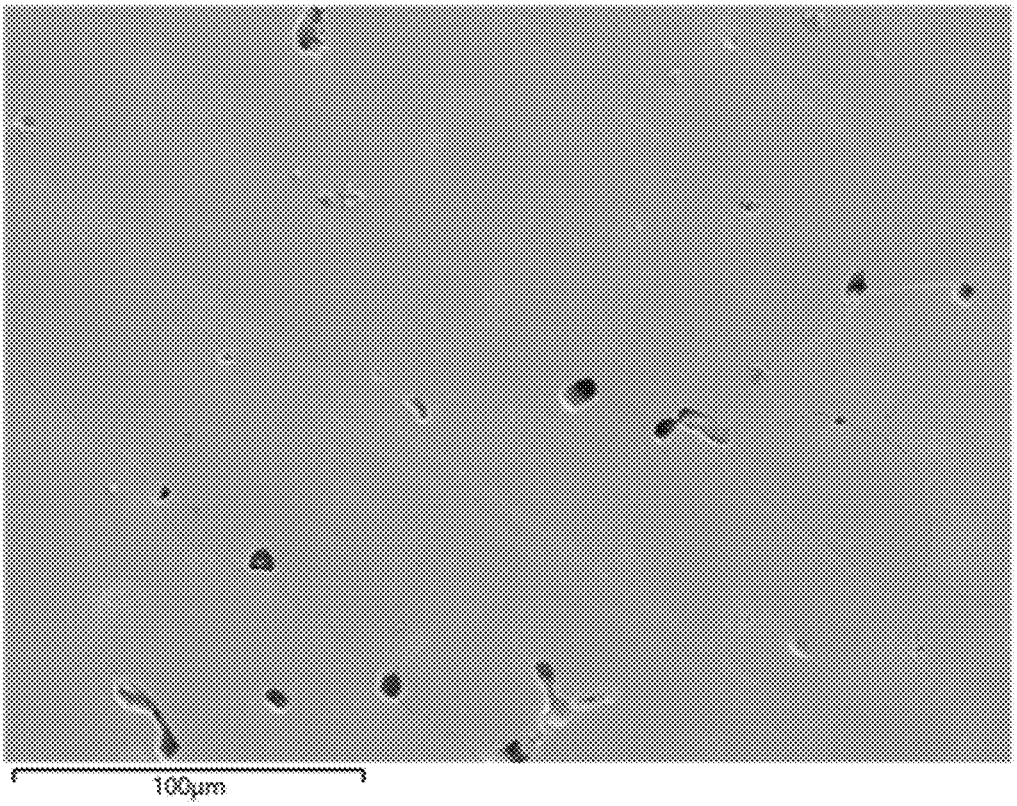
FIG. 10A shows a scanning electron microscope image of the $Al_{7.3}Co_{21.4}Cr_{10.6}Ti_{4.9}Fe_{21.4}Ni_{31.9}Cu_{2.5}$ casting HEA prepared in Example 2.
Figure 10B:
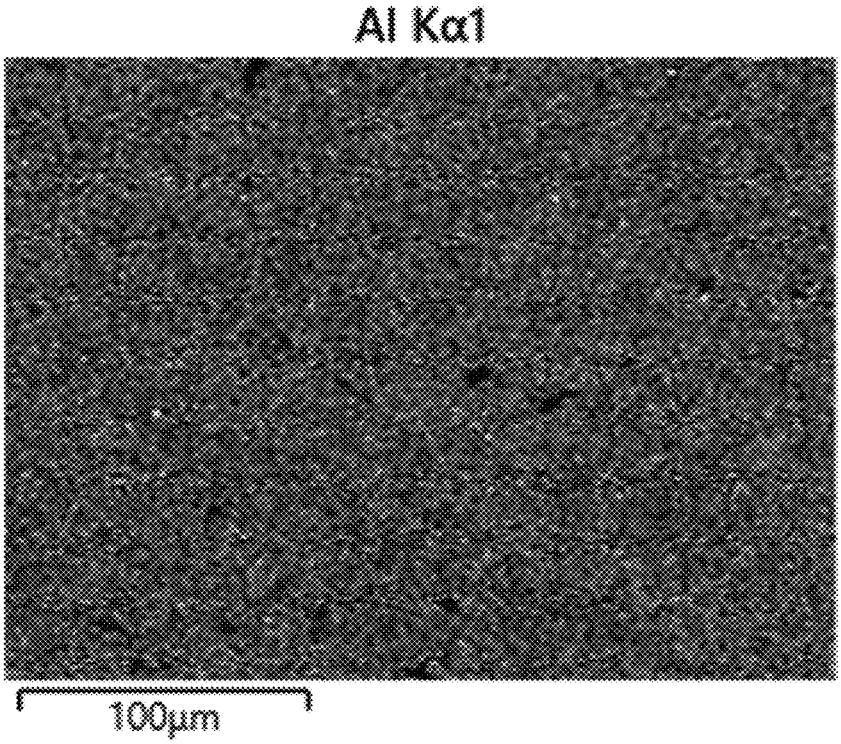
FIG. 10B shows an X-ray energy spectrum-based Al element area profile of the $Al_{7.3}Co_{21.4}Cr_{10.6}Ti_{4.9}Fe_{21.4}Ni_{31.9}Cu_{2.5}$ casting HEA prepared in Example 2.
Figure 10C:
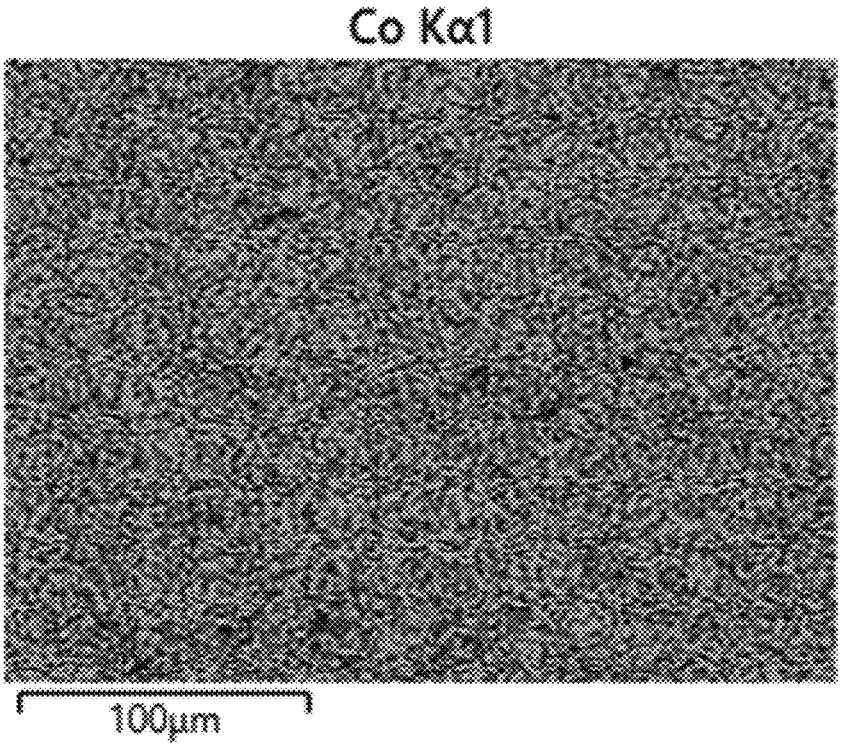
FIG. 10C shows an X-ray energy spectrum-based Co element area profile of the $Al_{7.3}Co_{21.4}Cr_{10.6}Ti_{4.9}Fe_{21.4}Ni_{31.9}Cu_{2.5}$ casting HEA prepared in Example 2.
Figure 10D:
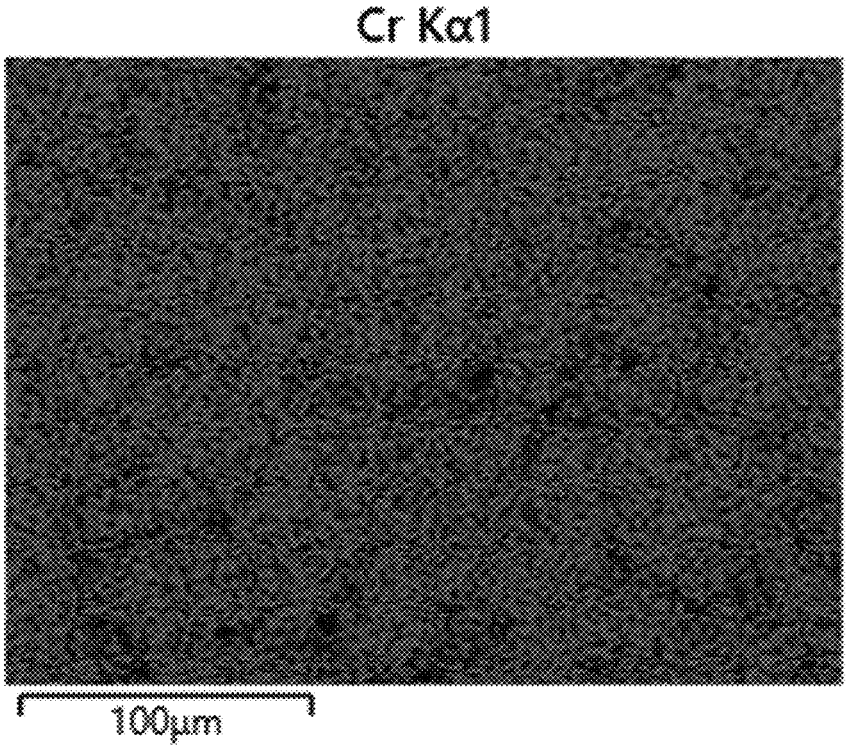
FIG. 10D shows an X-ray energy spectrum-based Cr element area profile of the $Al_{7.3}Co_{21.4}Cr_{10.6}Ti_{4.9}Fe_{21.4}Ni_{31.9}Cu_{2.5}$ casting HEA prepared in Example 2.
Figure 10E:
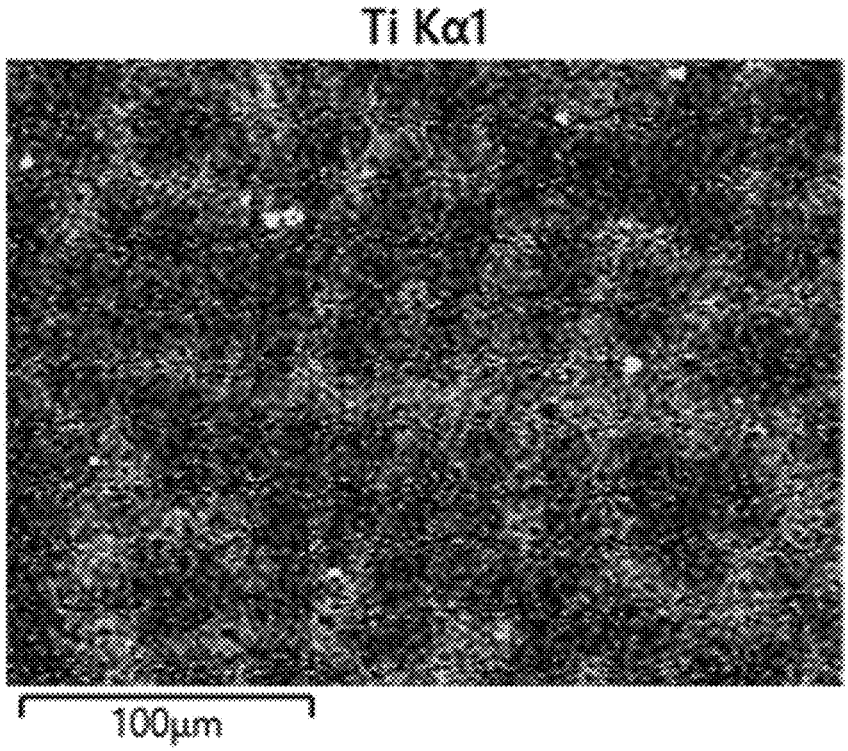
FIG. 10E shows an X-ray energy spectrum-based Ti element area profile of the $Al_{7.3}Co_{21.4}Cr_{10.6}Ti_{4.9}Fe_{21.4}Ni_{31.9}Cu_{2.5}$ casting HEA prepared in Example 2.
Figure 10F:
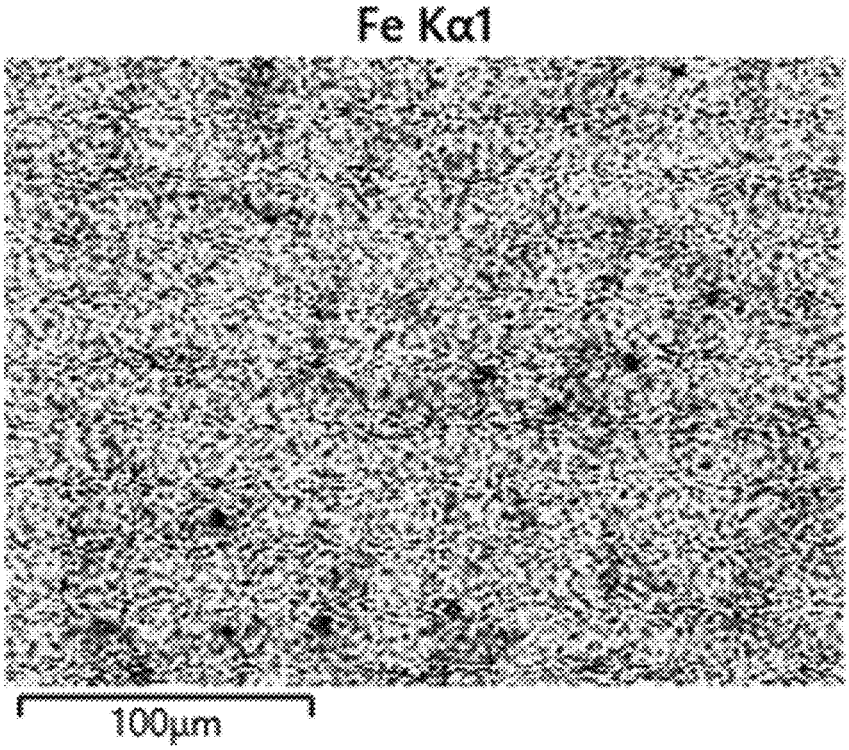
FIG. 10G shows an X-ray energy spectrum-based Ni element area profile of the $Al_{7.3}Co_{21.4}Cr_{10.6}Ti_{4.9}Fe_{21.4}Ni_{31.9}Cu_{2.5}$ casting HEA prepared in Example 2.
FIG. 10H shows an X-ray energy spectrum-based Cu element area profile of the $Al_{7.3}Co_{21.4}Cr_{10.6}Ti_{4.9}Fe_{21.4}Ni_{31.9}Cu_{2.5}$ casting HEA prepared in Example 2.
Figure 10G:
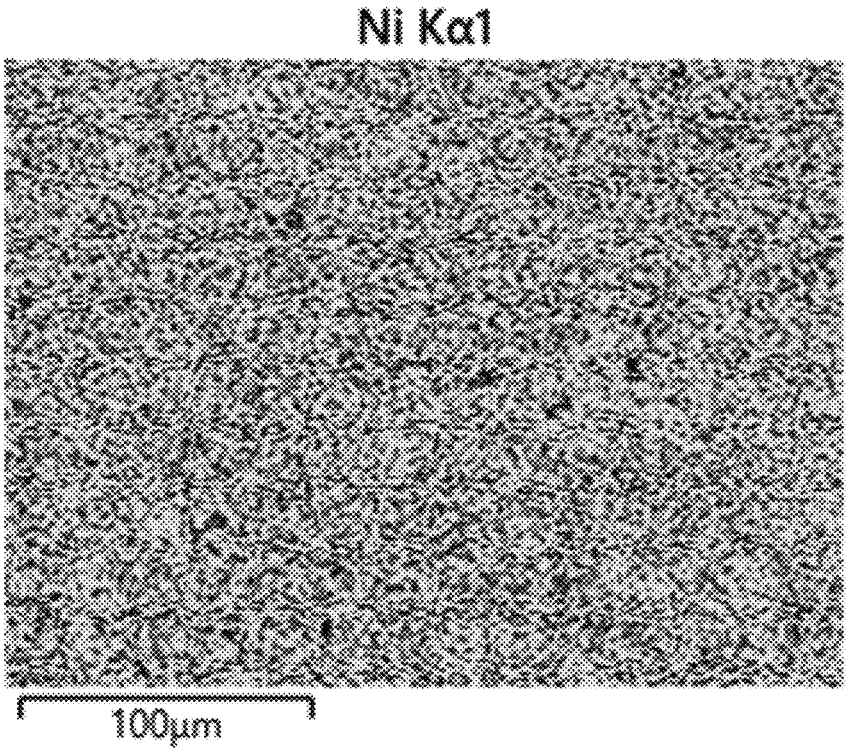
Figure 10H:
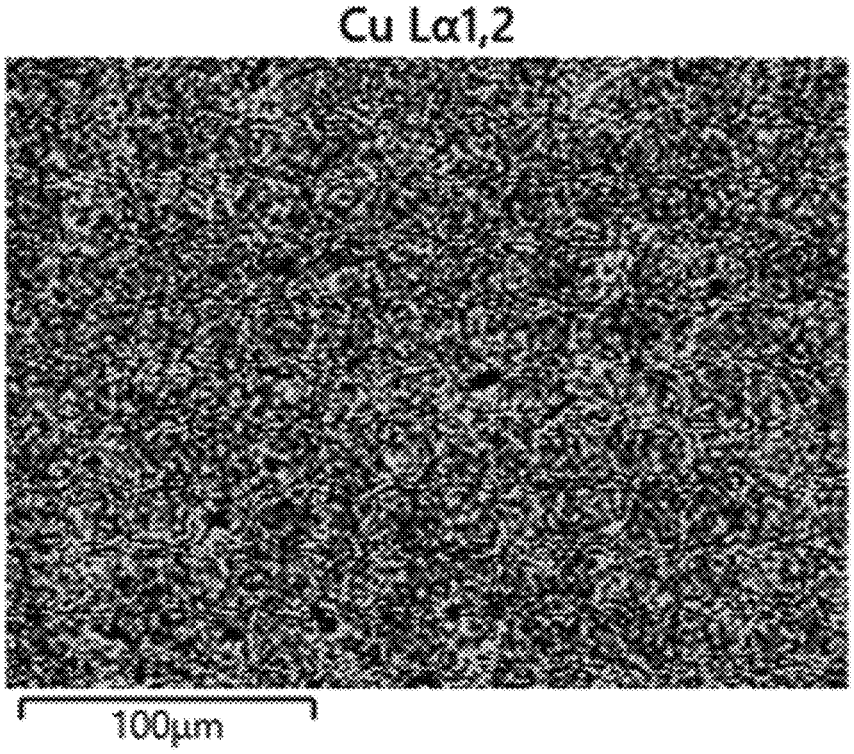
Figure 11:
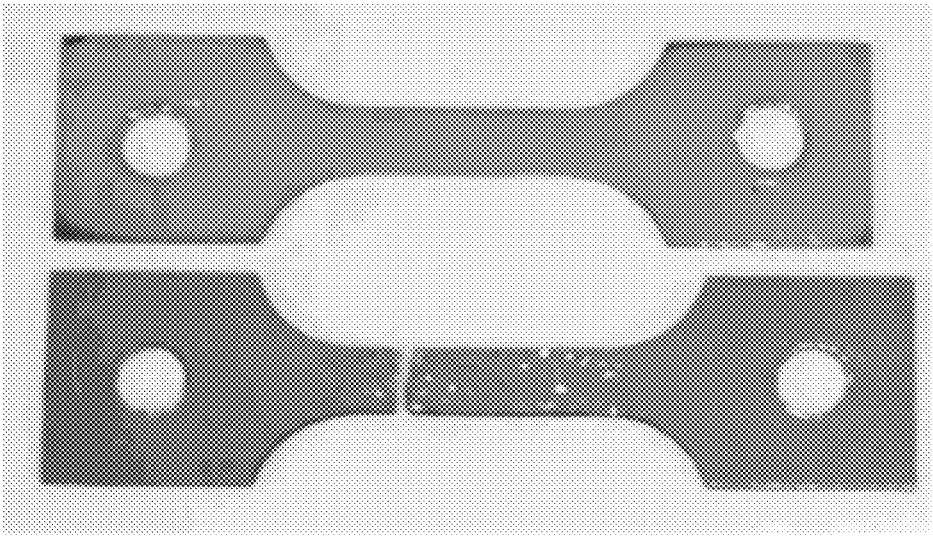
FIG. 11 shows comparison photos of an $Al_{7.2}Co_{20.7}Cr_{10.4}Ti_{4.8}Fe_{20.7}Ni_{31.2}Cu_{5.0}$ casting HEA sample prepared in Example 3 before and after stretching.

Experimental test and analysis:

The $Al_{7.3}Co_{21.4}Cr_{10.6}Ti_{4.9}Fe_{21.4}Ni_{31.9}Cu_{2.5}$ casting HEA prepared in this example was used as a test sample for experimental inspection. According to tensile test results in FIG. 7, the $Al_{7.3}Co_{21.4}Cr_{10.6}Ti_{4.9}Fe_{21.4}Ni_{31.9}Cu_{2.5}$ casting HEA has a tensile strength of 955 MPa and an elongation at break of 16.5%. It can be seen from a metallographic structure in FIG. 8 that the $Al_{7.3}Co_{21.4}Cr_{10.6}Ti_{4.9}Fe_{21.4}Ni_{31.9}Cu_{2.5}$ casting HEA is mainly composed of FCC and $L_12$ phases, with a uniformly-distributed casting dendritic structure. From a scanning electron microscope image in FIG. 9 and an element area profile in FIGS. 10A-10H, it can be seen that elements Co, Cr, Fe, and Ni are distributed in a dendrite region, while elements Cu, Al, and Ti are distributed in an interdendritic region.

EXAMPLE 3

A high-strength and high-plasticity casting HEA had a general formula of $Al_{7.2}Co_{20.7}Cr_{10.4}Ti_{4.8}Fe_{20.7}Ni_{31.2}Cu_{5.0}$.

A preparation method included the following steps:

step 1, pre-preparation of a sample:

high-purity particles of Al, Co, Cr, Cu, Fe, Ni, and Ti elementary substances each with a purity of not less than 99.95% were completely cleaned with ultrasonic acetone, and air-dried after cleaning; and clean raw materials with a total mass of 500.00 g±0.02 g were accurately weighed using an analytical balance and according to an atomic ratio of Al, Co, Cr, Ti, Fe, Ni and Cu at 7.2:20.7:10.4:4.8:20.7:31.2:5.0;

step 2, alloy melting:

cleaned high-purity metal raw materials Al, Co, Cr, Cu, Fe, Ni, and Ti were put into an inner working position of an electric arc smelting furnace, and a vacuum hood of the electric arc furnace was closed; a valve of an oil-sealed mechanical pump was opened, and the furnace was vacuumized using the oil-sealed mechanical pump to not more than $3.0\times10^{0}$ Pa; the valve of the oil-sealed mechanical pump was closed; a valve of a turbo molecular pump was opened, and the furnace was vacuumized using the turbo molecular pump to less than $6.0\times10^{-4}$ Pa; the turbo molecular pump valve was closed, a protective gas filling valve was opened, and the vacuum hood was filled with high-purity argon in a purity of 99.999% to complete the vacuumizing and filling; and alloy smelting was conducted: the alloys were put into stations of the smelting furnace separately, the metal Ti was smelted for deoxidation, and the rest of the metals were added for melting in the high-vacuum smelting furnace; after all the metals were melted, electromagnetic stirring was conducted to make a melt fully stirred; during the smelting, an alloy ingot was subjected to overturning type smelting 5 times with about 5 min in each time; and step 3, after the smelting was completed, an alloy obtained in step 2 was poured into a square water cooling plate-shaped copper mold for casting, cooled to room temperature to obtain the HEA.

A casting HEA with dimensions of 100 mm×100 mm×6 mm was obtained from a casting plate of the casting HEA prepared in step 3 by wire EDM and milling.

Figure 12:
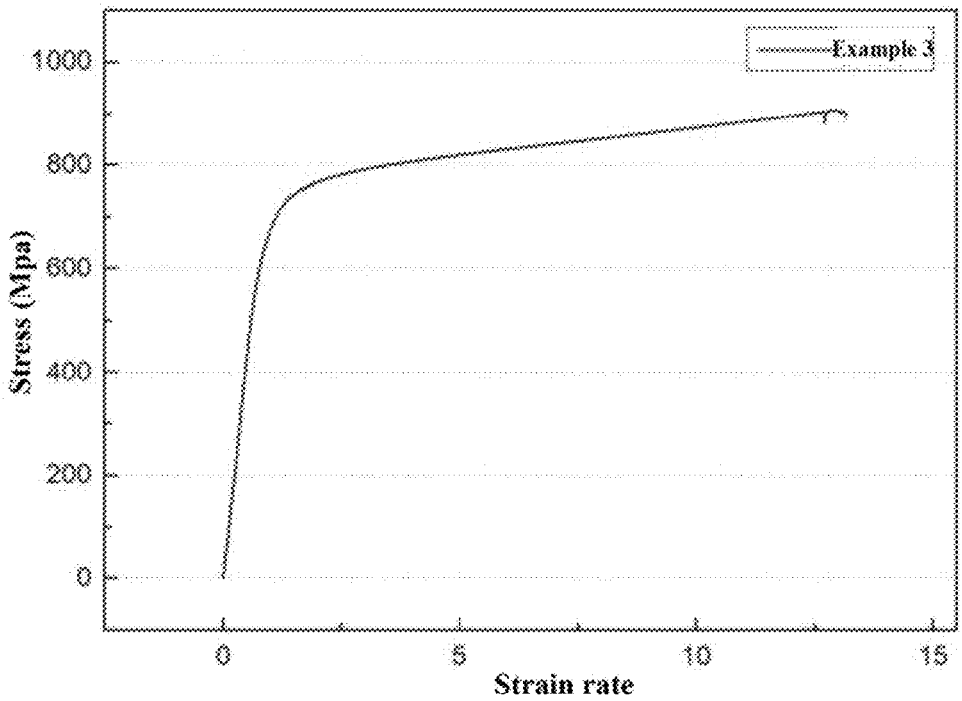
FIG. 12 shows an engineering stress-strain curve of static stretching of the $Al_{7.2}Co_{20.7}Cr_{10.4}Ti_{4.8}Fe_{20.7}Ni_{31.2}Cu_{5.0}$ casting HEA prepared in Example 3.
Figure 13:
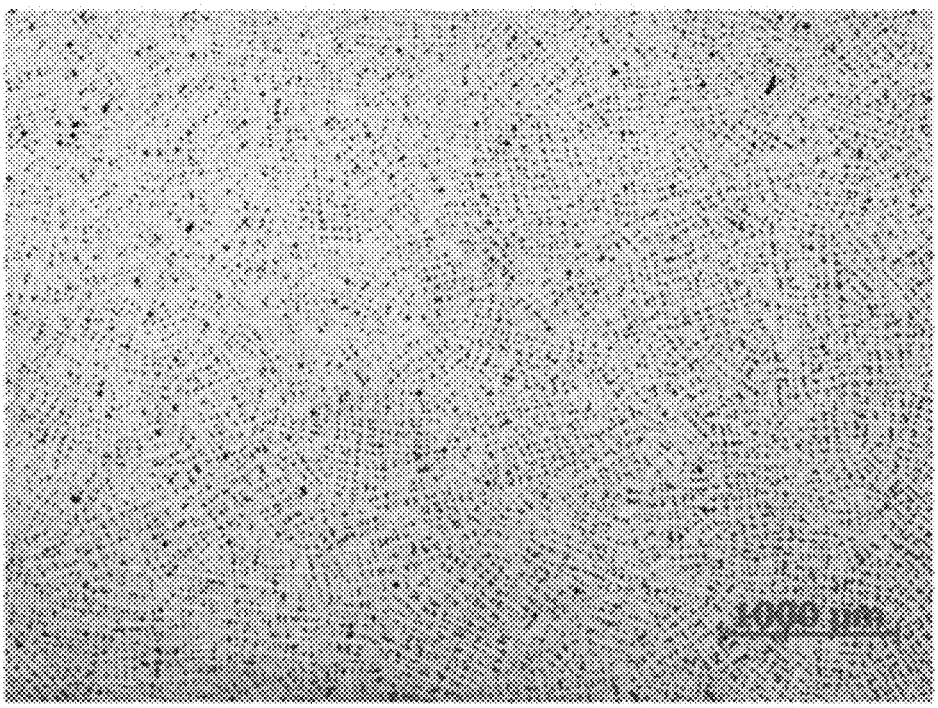
FIG. 13 shows a metallographic diagram of the $Al_{7.2}Co_{20.7}Cr_{10.4}Ti_{4.8}Fe_{20.7}Ni_{31.2}Cu_{5.0}$ casting HEA prepared in Example 3.
Figure 14:
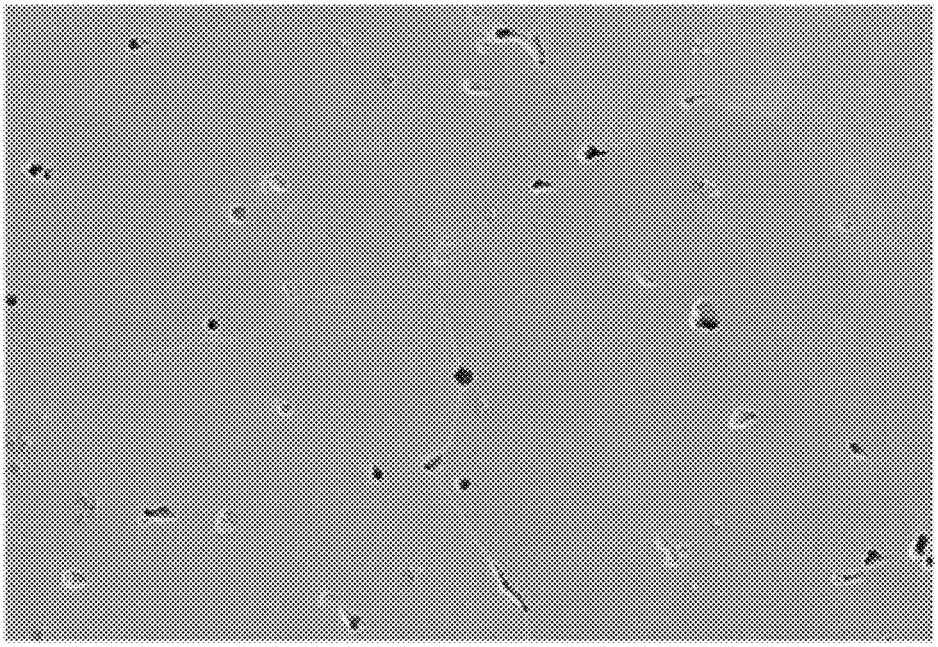
FIG. 14 shows a secondary electron image of the $Al_{7.2}Co_{20.7}Cr_{10.4}Ti_{4.8}Fe_{20.7}Ni_{31.2}Cu_{5.0}$ casting HEA prepared in Example 3.
Figure 15A:
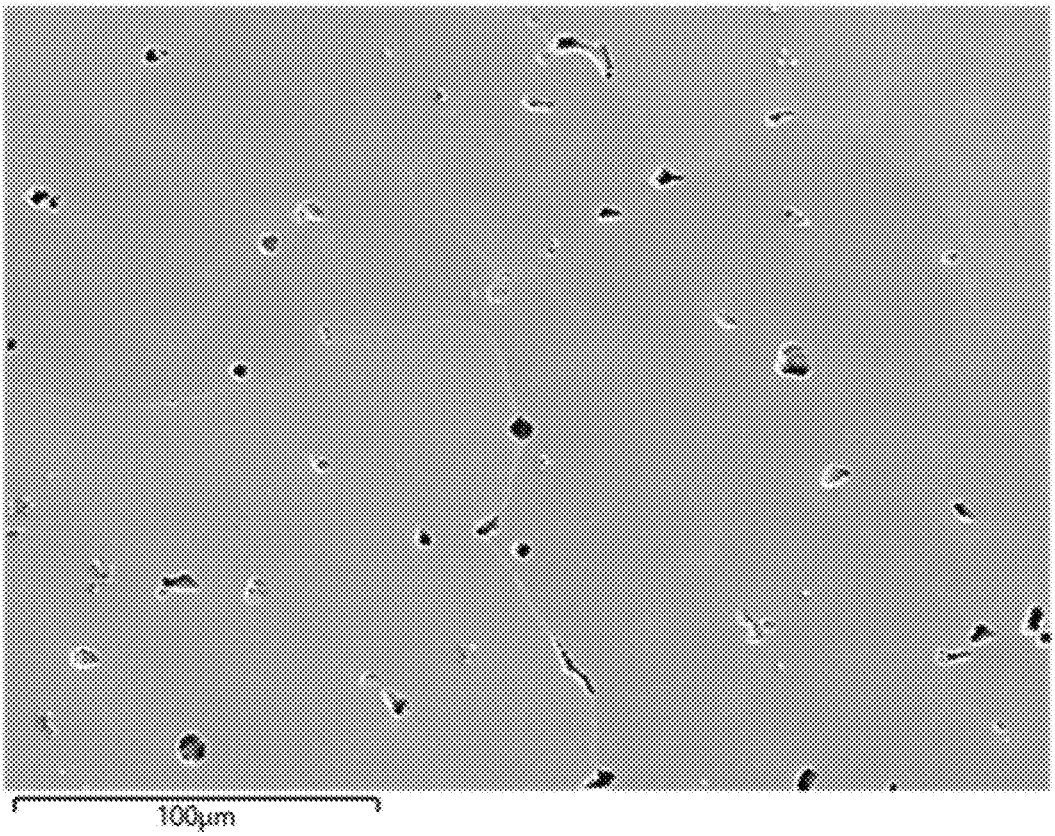
FIG. 15A shows a scanning electron microscope image of the $Al_{7.2}Co_{20.7}Cr_{10.4}Ti_{4.8}Fe_{20.7}Ni_{31.2}Cu_{5.0}$ casting HEA prepared in Example 3.
Figure 15B:
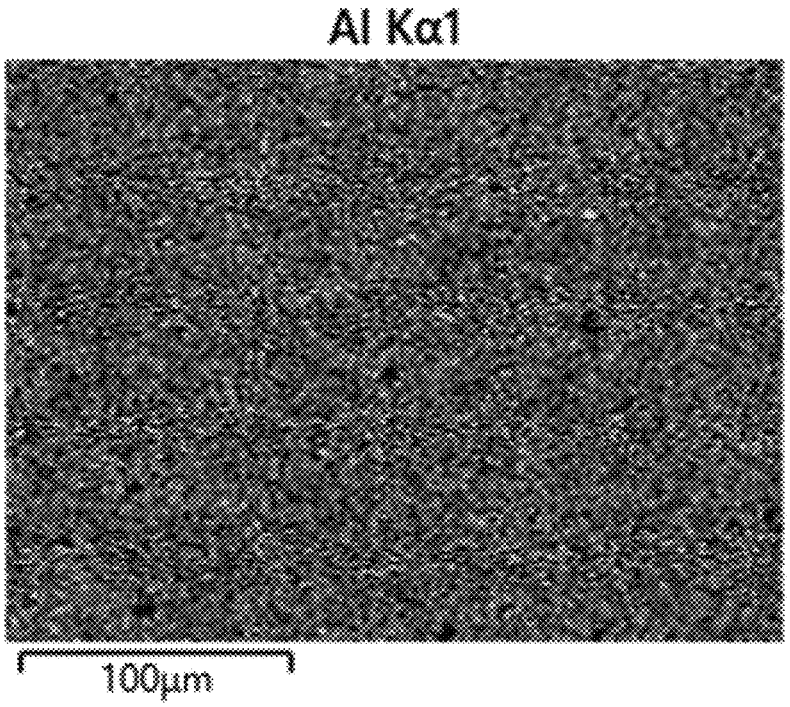
FIG. 15B shows an X-ray energy spectrum-based Al element area profile of the $Al_{7.2}Co_{20.7}Cr_{10.4}Ti_{4.8}Fe_{20.7}Ni_{31.2}Cu_{5.0}$ casting HEA prepared in Example 3.
Figure 15C:
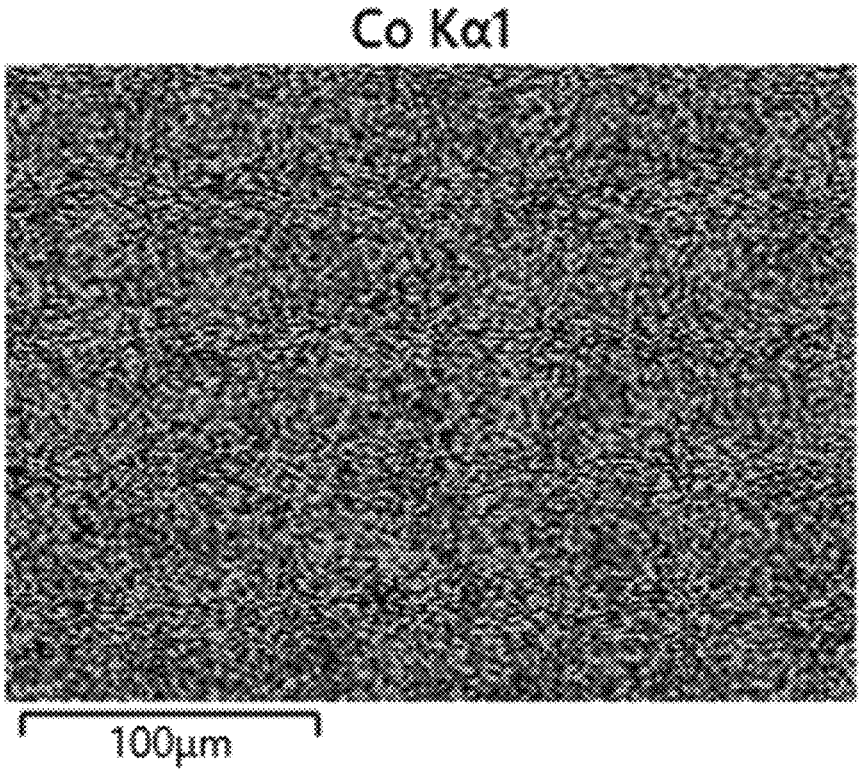
FIG. 15C shows an X-ray energy spectrum-based Co element area profile of the $Al_{7.2}Co_{20.7}Cr_{10.4}Ti_{4.8}Fe_{20.7}Ni_{31.2}Cu_{5.0}$ casting HEA prepared in Example 3.
Figure 15D:
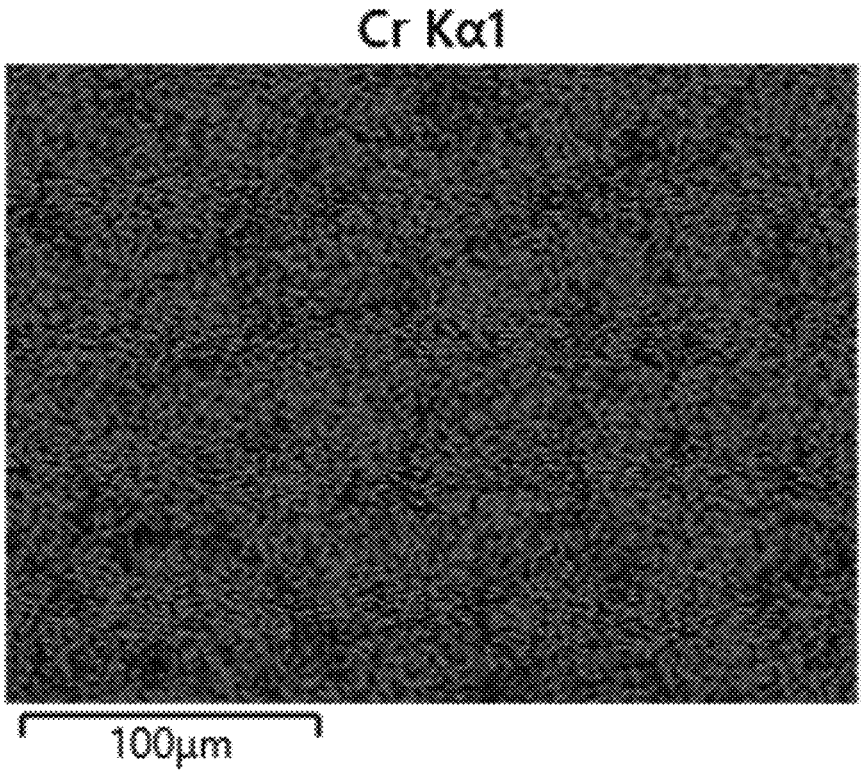
FIG. 15D shows an X-ray energy spectrum-based Cr element area profile of the $Al_{7.2}Co_{20.7}Cr_{10.4}Ti_{4.8}Fe_{20.7}Ni_{31.2}Cu_{5.0}$ casting HEA prepared in Example 3.
Figure 15E:
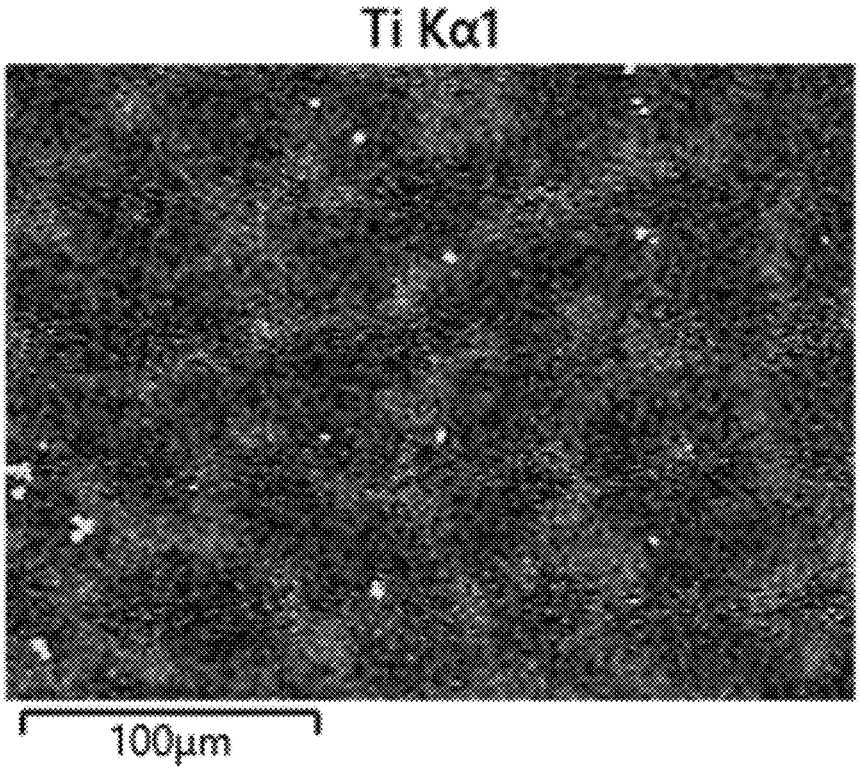
FIG. 15E shows an X-ray energy spectrum-based Ti element area profile of the $Al_{7.2}Co_{20.7}Cr_{10.4}Ti_{4.8}Fe_{20.7}Ni_{31.2}Cu_{5.0}$ casting HEA prepared in Example 3.
Figure 15F:
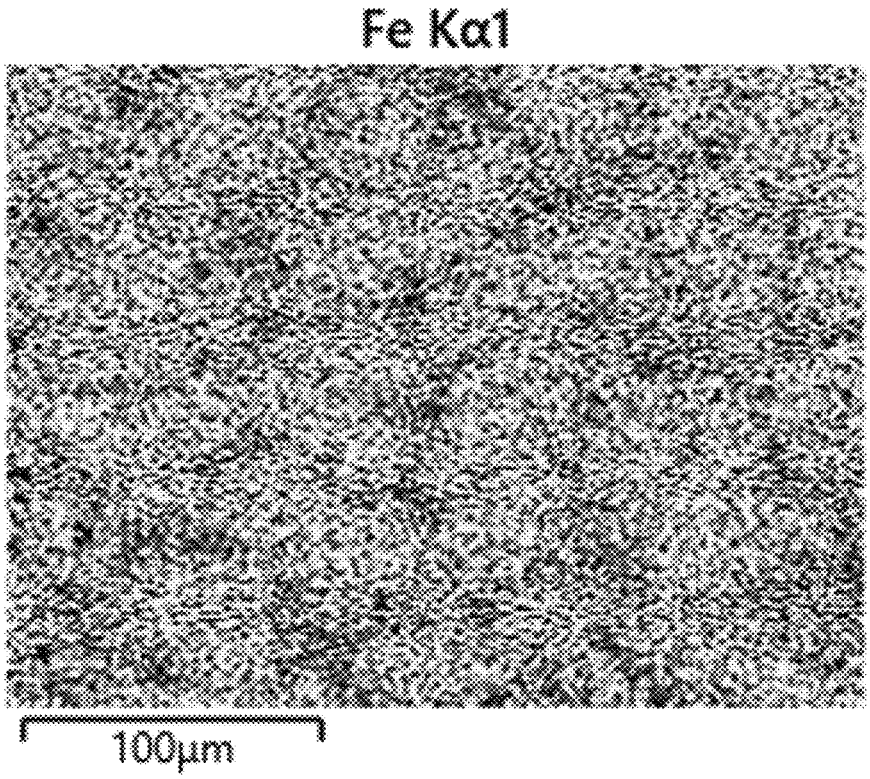
FIG. 15F shows an X-ray energy spectrum-based Fe element area profile of the $Al_{7.2}Co_{20.7}Cr_{10.4}Ti_{4.8}Fe_{20.7}Ni_{31.2}Cu_{5.0}$ casting HEA prepared in Example 3.
Figure 15G:
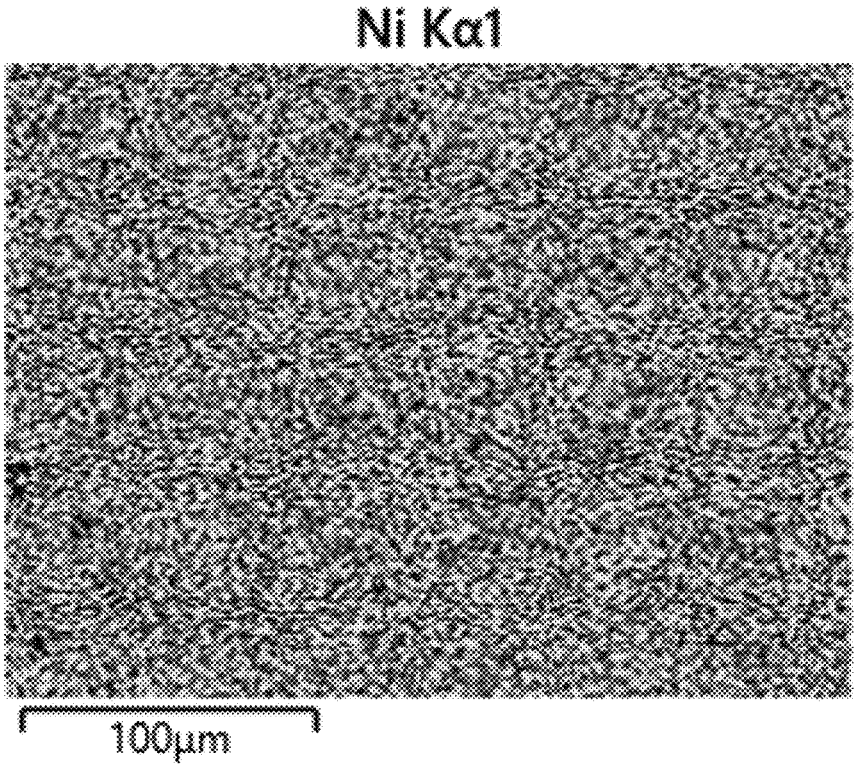
FIG. 15G shows an X-ray energy spectrum-based Ni element area profile of the $Al_{7.2}Co_{20.7}Cr_{10.4}Ti_{4.8}Fe_{20.7}Ni_{31.2}Cu_{5.0}$ casting HEA prepared in Example 3.
Figure 15H:
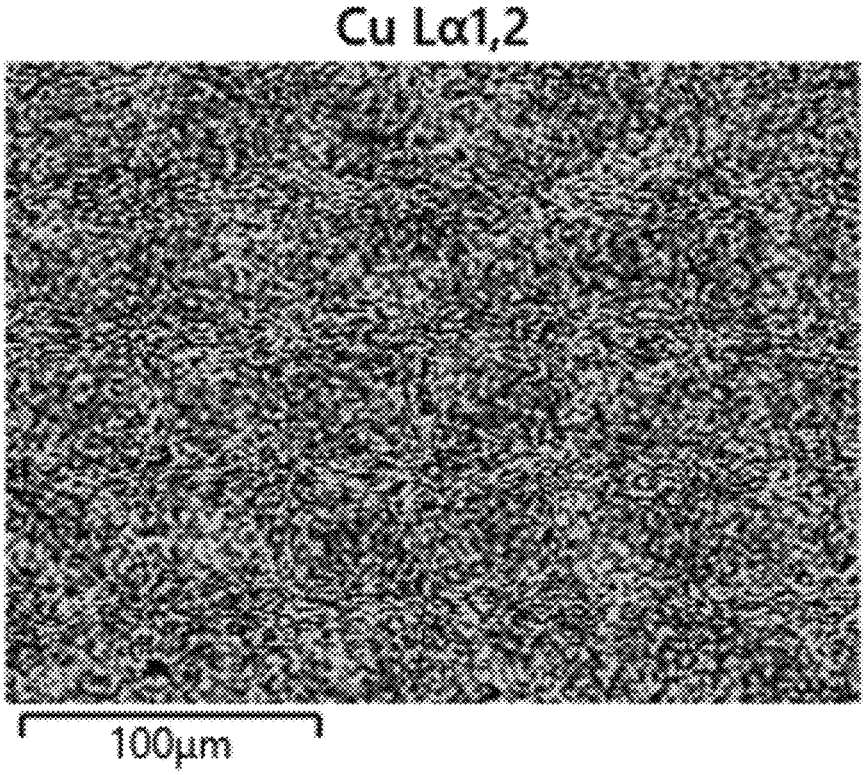
FIG. 15H shows an X-ray energy spectrum-based Cu element area profile of the $Al_{7.2}Co_{20.7}Cr_{10.4}Ti_{4.8}Fe_{20.7}Ni_{31.2}Cu_{5.0}$ casting HEA prepared in Example 3.

Experimental test and analysis:

The $Al_{7.2}Co_{20.7}Cr_{10.4}Ti_{4.8}Fe_{20.7}Ni_{31.2}Cu_{5.0}$ casting HEA prepared in this example was used as a test sample for experimental inspection. According to tensile test results in FIG. 12, the $Al_{7.2}Co_{20.7}Cr_{10.4}Ti_{4.8}Fe_{20.7}Ni_{31.2}Cu_{5.0}$ casting HEA has a tensile strength of 906 MPa and an elongation at break of 13.1%. It can be seen from a metallographic structure in FIG. 13 that the $Al_{17.2}Co_{20.7}Cr_{10.4}Ti_{4.8}Fe_{20.7}Ni_{31.2}Cu_{5.0}$ casting HEA is mainly composed of FCC and $L_12$ phases, with a uniformly-distributed casting dendritic structure. From a scanning electron microscope image in FIG. 14 and an element area profile in FIGS. 15A-15H, it can be seen that elements Co, Cr, Fe, and Ni are distributed in a dendrite region, while elements Cu, Al, and Ti are distributed in an interdendritic region.

In summary, the present disclosure provides a high-strength and high-plasticity casting HEA, and a preparation method thereof that is simple and easy to implement. By designing the composition and using a simple vacuum casting technology, HEAs with high strength and desirable plasticity can be obtained by industrial production. The HEA has a casting dendritic structure, with an excellent tensile strength and desirable plasticity, and has extremely broad prospects for use in the engineering field. The present disclosure further discloses a preparation method of the HEA. The high-strength and high-plasticity casting HEA with excellent mechanical properties can be obtained by only one-step casting. The preparation method is simple and safe, which can meet industrial production conditions.

What is claimed is:

1. A casting alloy, having a general formula of AlaCobCrcTidFeeNifCug, wherein $6.0<a<8.0$, $18.0<b\leq23.0$, $7.5\leq c<12.5$, $2.0<d\leq8.5$, $15.5<e\leq21.9$, $28.0<f\leq37.0$, $0.2<g\leq0.6$, and $a+b+c+d+e+f+g=100$.

2. The casting alloy according to claim 1, wherein in the general formula of the casting alloy, $6.9<a\leq7.5$, $20.2<b\leq21.9$, $10.1\leq c<11.0$, $4.6<d\leq5.0$, $20.2<e\leq21.9$, $30.3<f\leq32.9$, and $0.5<g\leq0.6$.

3. The casting alloy HEA according to claim 1, wherein the casting alloy HEA has a tensile strength of 900 MPa to 1,200 MPa and an elongation of 15% to 24%.

4. A preparation method of the casting alloy according to claim 1, comprising the following steps:

step 1): completely cleaning bulk particles of Al, Co, Cr, Cu, Fe, Ni, and Ti elementary substances, and weighing according to a proportion;

step 2): vacuumizing a vacuum smelting furnace to not more than 6.0×10-4 Pa, and introducing a protective gas; adding Ti into the vacuum smelting furnace for deoxidation, adding the rest of the elementary substances for melting, and stirring for smelting; and step 3): after the smelting is completed, pouring an alloy obtained in step 2) into a water cooling plate-shaped copper mold for casting, cooling to room temperature, and collecting a finished product.

5. The preparation method of the casting alloy according to claim 4, wherein in the general formula of the casting alloy, $6.9<a\leq7.5$, $20.2<b\leq21.9$, $10.1\leq c<11.0$, $4.6<d\leq5.0$, $20.2<e\leq21.9$, $30.3<f\leq32.9$, and $0.5<g\leq0.6$.

6. The preparation method of the casting alloy according to claim 4, wherein the casting alloy has a tensile strength of 900 MPa to 1,200 MPa and an elongation of 15% to 24%.

7. The preparation method of the casting alloy according to claim 4, wherein in step 1), the elementary substances each have a purity of not less than 99.95%.

8. The preparation method of the casting alloy according to claim 5, wherein in step 1), the elementary substances each have a purity of not less than 99.95%.

9. The preparation method of the casting alloy according to claim 6, wherein in step 1), the elementary substances each have a purity of not less than 99.95%.

10. The preparation method of the casting alloy according to claim 4, wherein in step 2), the vacuum smelting furnace is a vacuum arc smelting furnace or a vacuum induction smelting furnace.

11. The preparation method of the casting alloy according to claim 5, wherein in step 2), the vacuum smelting furnace is a vacuum arc smelting furnace or a vacuum induction smelting furnace.

12. The preparation method of the casting alloy according to claim 6, wherein in step 2), the vacuum smelting furnace is a vacuum arc smelting furnace or a vacuum induction smelting furnace.

13. The preparation method of the casting alloy according to claim 4, wherein in step 2), the protective gas is argon or other gas that does not react with metal raw materials, having a purity of 99.999%.

14. The preparation method of the casting alloy according to claim 5, wherein in step 2), the protective gas is argon or other gas that does not react with metal raw materials, having a purity of 99.999%.

15. The preparation method of the casting alloy according to claim 6, wherein in step 2), the protective gas is argon or other gas that does not react with metal raw materials, having a purity of 99.999%.

16. The preparation method of the casting alloy according to claim 4, wherein in step 2), the smelting is conducted by overturning type smelting 5 times with 5 min in each time.

17. The preparation method of the casting alloy according to claim 5, wherein in step 2), the smelting is conducted by overturning type smelting 5 times with 5 min in each time.

18. The preparation method of the casting alloy according to claim 6, wherein in step 2), the smelting is conducted by overturning type smelting 5 times with 5 min in each time.

19. The preparation method of the casting alloy according to claim 4, wherein in step 3), the alloy has a thickness of not less than 8 mm.

20. The preparation method of the casting alloy according to claim 4, wherein in step 3), the alloy has a uniformly-distributed dendritic structure.

* * * * *